US006705536B1

(12) United States Patent
Birt et al.

(10) Patent No.: US 6,705,536 B1
(45) Date of Patent: Mar. 16, 2004

(54) CONCRETE RAILROAD GRADE CROSSING PANELS

(75) Inventors: Randall G. Birt, Omaha, NE (US); Thomas L. Egan, Omaha, NE (US)

(73) Assignee: American Concrete Products Co., Omaha, NE (US)

( * ) Notice: Subject to any disclaimer, the term of this patent is extended or adjusted under 35 U.S.C. 154(b) by 0 days.

(21) Appl. No.: 10/268,398

(22) Filed: Oct. 10, 2002

Related U.S. Application Data

(63) Continuation-in-part of application No. 10/147,234, filed on May 15, 2002, which is a continuation-in-part of application No. 10/103,308, filed on Mar. 20, 2002, now Pat. No. 6,588,676.

(51) Int. Cl.[7] ..... E01B 2/00
(52) U.S. Cl. ..... 238/8; 404/64
(58) Field of Search ..... 238/2, 8, 6, 7, 238/379, 382, 3, 5, 9; 404/32, 33, 64, 65, 69

(56) References Cited

U.S. PATENT DOCUMENTS

| | | | |
|---|---|---|---|
| 1,694,557 | A | 12/1928 | Oettinger |
| 2,789,771 | A | 4/1957 | Bishop |
| 2,950,057 | A | 8/1960 | Speer |
| 3,056,555 | A | 10/1962 | Eisses |
| 3,066,869 | A | 12/1962 | Bishop |
| 3,469,783 | A | 9/1969 | Uralli et al. |
| 3,825,184 | A | 7/1974 | Hartl |
| 3,863,840 | A | 2/1975 | Szarka et al. |
| 3,892,356 | A | 7/1975 | Harmon |
| 3,955,761 | A | 5/1976 | Szarka et al. |
| 4,093,120 | A | 6/1978 | Canfield |
| 4,147,304 | A | 4/1979 | Blyton |
| 4,236,670 | A | 12/1980 | Limmergard et al. |
| 4,253,605 | A | 3/1981 | Sims |
| 4,267,969 | A | 5/1981 | Hales et al. |
| 4,365,743 | A | 12/1982 | Trickel et al. |
| 4,368,845 | A | 1/1983 | Perry et al. |
| 4,449,666 | A | 5/1984 | Hales et al. |
| 4,457,468 | A | 7/1984 | Hales et al. |
| 4,461,421 | A | 7/1984 | Maass |

(List continued on next page.)

FOREIGN PATENT DOCUMENTS

| | | |
|---|---|---|
| DE | 1012628 | 4/1957 |
| DE | 2350759 A1 | 4/1975 |
| JP | 2887720 | 5/1994 |
| RU | 2001985 C1 | 10/1993 |

*Primary Examiner*—Mark T. Le
(74) *Attorney, Agent, or Firm*—Thomte, Mazour & Neibergall; Dennis L. Thomte

(57) ABSTRACT

A concrete railroad grade crossing comprised of a precast concrete gauge panel extending between the rails and precast concrete approach panels which extend between each rail and the roadway. Elastomeric gauge seals are provided on the opposite sides of the gauge panels for sealing the space between the sides of the gauge panels and the rails. Elastomeric approach seals are provided on the inner ends of the approach panels for engagement with the outer sides of the rails. The inner end of each of the seals has a lobe formed therein which is embedded in the respective panels. Each of the lobes has an elongated bore or opening formed therein which has a rebar positioned therein. Portions of the lobe are cut away to expose the rebar. The exposed portions of the rebar are connected to DBAs in the panel by tie wires to firmly attach the seal to the panel.

7 Claims, 6 Drawing Sheets

U.S. PATENT DOCUMENTS

| | | | | | |
|---|---|---|---|---|---|
| 4,641,779 | A | | 2/1987 | O'brien et al. | |
| 4,691,863 | A | | 9/1987 | Smith | |
| 4,793,545 | A | | 12/1988 | Raymond | |
| 4,823,452 | A | * | 4/1989 | Cloutier | 29/235 |
| 4,860,952 | A | | 8/1989 | Schmidt | |
| 4,899,932 | A | | 2/1990 | Beachy et al. | |
| 4,899,933 | A | | 2/1990 | Martin | |
| 4,911,360 | A | | 3/1990 | Spurr | |
| 5,035,533 | A | * | 7/1991 | Brown | 404/64 |
| 5,096,117 | A | | 3/1992 | Owen | |
| 5,181,657 | A | | 1/1993 | Davis | |
| 5,464,152 | A | | 11/1995 | Wabnitz | |
| 5,535,947 | A | | 7/1996 | Hogue et al. | |
| 5,535,948 | A | | 7/1996 | Williams | |
| 5,538,182 | A | | 7/1996 | Davis et al. | |
| 5,609,294 | A | | 3/1997 | Lucas, Jr. | |
| 5,626,289 | A | | 5/1997 | Demers, Jr. et al. | |
| 5,655,711 | A | | 8/1997 | Hull et al. | |
| 5,740,961 | A | | 4/1998 | Bruning | |
| 5,813,602 | A | * | 9/1998 | Holland | 238/8 |
| 5,850,970 | A | | 12/1998 | Hull et al. | |
| 5,899,379 | A | | 5/1999 | Bruyn et al. | |
| 6,068,195 | A | | 5/2000 | Gaudet | |
| 6,079,630 | A | | 6/2000 | Schroeder | |
| 6,129,288 | A | * | 10/2000 | Petersen et al. | 238/8 |
| 6,431,462 | B1 | | 8/2002 | Apostolou et al. | |

* cited by examiner

CONCRETE RAILROAD GRADE CROSSING PANELS

CROSS-REFERENCE TO RELATED APPLICATION

This is a continuation-in-part application of Petitioners' earlier application Ser. No. 10/147,234 filed May 15, 2002, entitled "CONCRETE RAILROAD GRADE CROSSING PANELS" which is a continuation-in-part application of Petitioners' earlier application Ser. No. 10/103,308 filed Mar. 20, 2002, entitled "CONCRETE RAILROAD GRADE CROSSING PANELS", now U.S. Pat. No. 6,588,676.

BACKGROUND OF THE INVENTION

1. Field of the Invention

This invention relates to an improved concrete railroad grade crossing and more particularly to an improved railroad grade crossing comprising concrete gauge panels which extend between the rails and further comprising concrete approach or field panels which extend between each rail and the roadway. Even more particularly, the invention relates to improved elastomeric gauge seals which are partially cast in the sides of the gauge panels and relates to improved elastomeric approach or field seals which are partially cast in the inner ends of the approach or field panels. More particularly, the invention relates to the means for securing the seals to the panels through the use of a bar, rod or shaft ("bar") extending through the seal with the bar being secured to the retainers which hold the associated edge protector in place.

2. Description of the Prior Art

Frequently, a railroad track crosses a roadway which necessitates that the space between the rails be filled with a material which brings that space up to grade. It is also necessary to bring the approaches on either side of the rails up to grade. In the past, precast concrete panels, or gauge panels, have been positioned between the rails and precast concrete panels, or approach or field panels, have been positioned on the approach sides of the track. The prior art railroad grade crossings have also used elastomeric seals on the sides of the concrete gauge panels to fill the space between the gauge panels and the rails to prevent foreign materials from entering and filling the space between the gauge panels and the rail. The prior art railroad grade crossings have also used elastomeric seals on the inner ends of the concrete field panels to prevent foreign materials from entering and filling the space between the field panel and the associated rail. In some cases, the upper inner ends of the field panels and the upper outer ends of the gauge panels were chamfered or beveled to prevent portions of the concrete field panels and gauge panels from chipping off and filling the spaces between the panels and the rails. In other cases, angle irons have been used as edge protectors to prevent the chipping problem.

In later years, the gauge seals and field seals have been partially embedded in the concrete panels to aid in attaching the seals to the panels. However, even where the seals are partially embedded in the prior art concrete panels, it is believed that the prior art devices experience some attachment problems of the seals. Petitioners' co-pending applications are believed to solve at least some of the attachment problems. The instant invention is believed to represent a further advance in the art.

SUMMARY OF THE INVENTION

A railroad grade crossing for extending a roadway across a pair of parallel spaced-apart rails is disclosed. The railroad grade crossing includes one or more concrete gauge panels which extend substantially between the rails. Each of the gauge panels has a top surface which is substantially coplanar with the roadway with the bottom surface of the gauge panel being supported upon the ties. Each of the gauge panels has an elongated elastomeric gauge seal on each side thereof which is positioned adjacent the rails. The upper ends of the gauge seals are positioned downwardly from the top surface of the gauge panel with the upper ends of the gauge seals having arcuate recessed portions formed therein adjacent the outer ends thereof. The lower inner ends of the gauge seals are at least partially cast in the outer ends of the gauge panels. Concrete approach panels or field panels are positioned between each rail and the roadway associated therewith. Each of the concrete field panels has a top surface which is substantially coplanar with the roadway and a bottom surface which is supported upon the ties. The field panels have elongated elastomeric field seals at their inner ends thereof with the upper ends of the field seals being preferably positioned downwardly from the top surface of the field panels. The lower inner ends of the field seals are at least partially cast in the inner ends of the field panels. Elongated, metal angle members (edge protectors) are cast in the upper outer edges of the gauge panels and the upper inner edges of the field panels and are maintained therein by horizontally disposed DBAs (deformed bar anchors) and by vertically disposed headed studs. The inner end of each of the field seals and the inner end of each of the gauge seals has a lobe formed thereon which has an opening extending lengthwise therethrough. An elongated metal bar is positioned in and extends along the length of the opening formed in the lobe. Portions of the lobe are cut away to expose the bar. The exposed portions of the bar are secured by tie wires or the like to the DBAs to securely maintain the seal in the panel.

It is therefore a principal object of the invention to provide an improved concrete railroad grade crossing.

A further object of the invention is to provide an improved concrete railroad grade crossing comprising concrete gauge panels and concrete field panels wherein elastomeric seals are partially embedded in the panels and extend therefrom so as to be positioned adjacent the rails.

Still another object of the invention is to provide an improved concrete railroad grade crossing including elastomeric gauge seals and field seals which have voids formed therein so as to reduce the amount of elastomeric material required to construct the same.

Still another object of the invention is to provide an improved concrete railroad grade crossing including concrete gauge and field panels which have elastomeric seals partially embedded therein.

Still another object of the invention is to provide an improved method of attaching elastomeric gauge and field seals to gauge panels and approach panels, respectively.

Still another object of the invention is to provide an improved railroad crossing which has greater durability than the railroad grade crossings of the prior art.

These and other objects will be apparent to those skilled in the art.

DESCRIPTION OF THE PREFERRED EMBODIMENT

Figure 1:
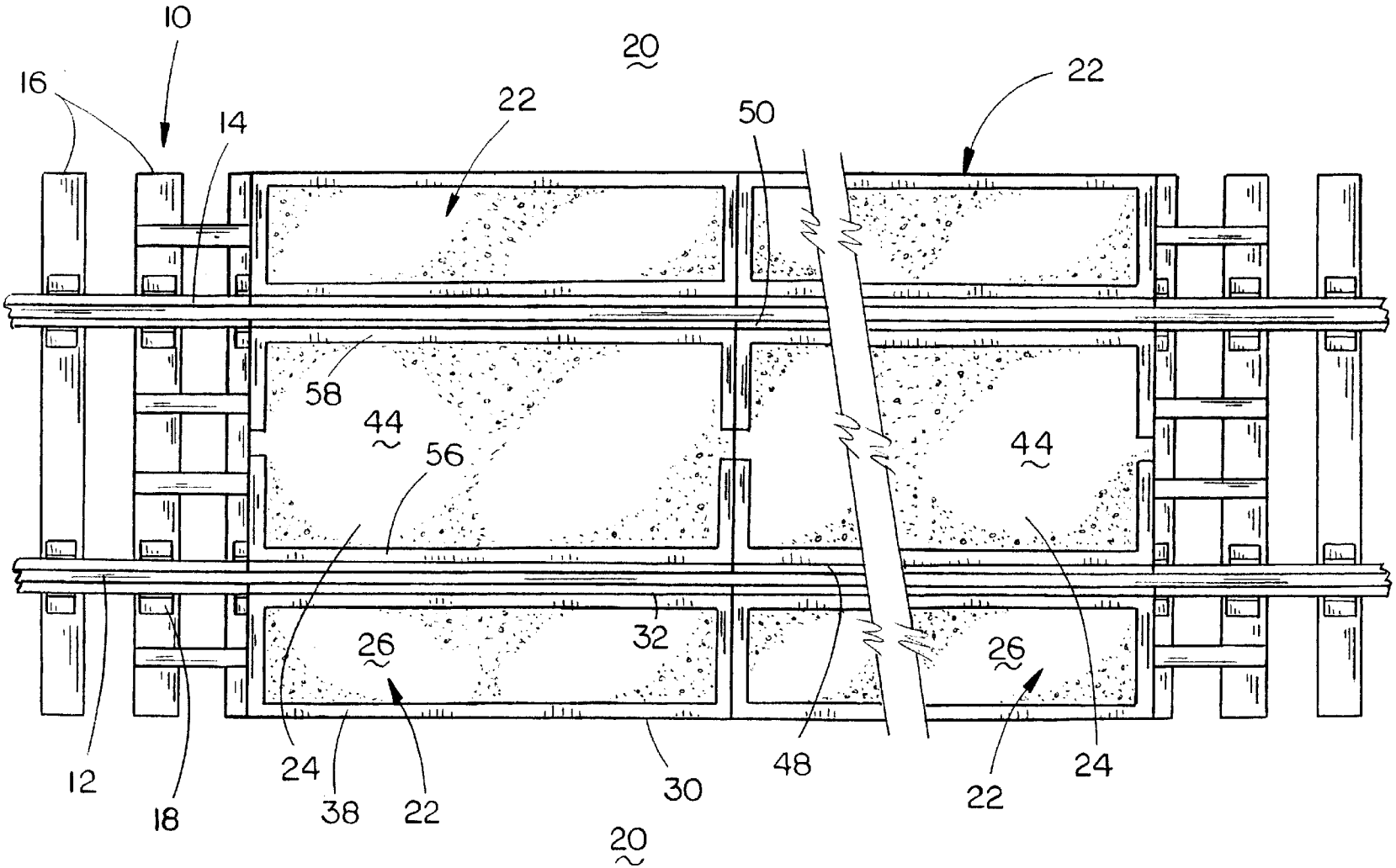
FIG. 1 is a partial top plan view of the concrete railroad grade crossing of this invention.

In the drawings, the numeral 10 refers to a railroad track including rails 12 and 14 which are supported upon a plurality of spaced-apart ties 16 by means of tie plates 18 which are secured to the ties 16 in conventional fashion such as by spikes, clips or bolts. In many cases, the railroad track 10 must cross a roadway which is generally referred to by the reference numeral 20.

Normally, a plurality of precast concrete approach or field panels 22 will be positioned between the roadway 20 and the rails 12 and 14 with the field panels 22 being supported upon the outer ends of the ties 16. Normally, the field panels 22 will be positioned between the roadway 20 and one of the rails in an end-to-end fashion, the number of which will depend upon the width of the roadway and the length of the field panels. The numeral 24 refers to precast concrete gauge panels which are positioned between the rails 12 and 14 and which are supported upon the ties 16. The gauge panels 24 are supported upon the ties 16 in an end-to-end fashion, the number of which will depend upon the width of the roadway and the length of the gauge panels.

Each of the approach or field panels 22 is comprised of a precast concrete material and includes top surface 26, bottom surface 28, and opposite sides 30 and 32. Field panel 22 is provided with a recessed portion 34 formed therein at each of the opposite sides thereof to provide a clearance space for the spikes, bolts, clips, etc., which secure the tie plates 18 to the ties 16 and which secure the rail to the tie plate 18 in conventional fashion.

An elongated, metal angle member 38 (edge protector) is cast in the field panel 22 at the upper inner side thereof, as illustrated in the drawings, and which is held in place in the concrete by horizontally disposed and horizontally spaced retainers, rods or bars 40 secured thereto which are commonly referred to as DBAs (deformed bar anchors). The angle member 38 is also held in place by a plurality of vertically disposed and horizontally spaced retainers or studs 41 secured thereto having enlarged head portions 41*a* at their lower ends. As will be explained in more detail hereinafter, a field seal 42 is secured to the inner end of each of the field panels 22.

Figure 2:
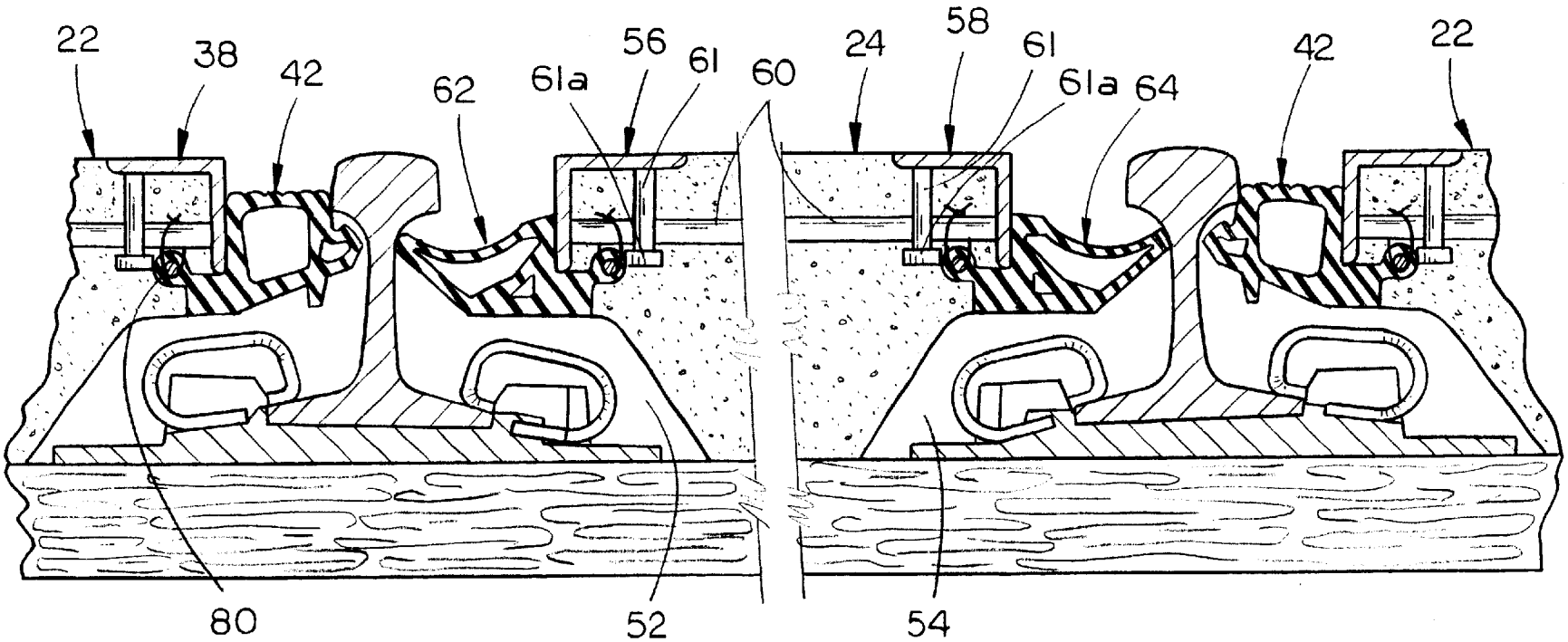
FIG. 2 is a partial vertical sectional view of the concrete railroad grade crossing of this invention.

Each of the gauge panels 24 is comprised of a precast concrete material and includes top surface 44, bottom surface 46, and opposite sides 48 and 50. Gauge panel 24 is provided with a recessed portion 52 at side 48 and is provided with a recessed portion 54 at its side 50, as seen in FIG. 2, to provide a clearance space for the spikes, bolts, clips, etc., which secure the tie plates 18 to the ties 16 and which secure the rails to the tie plates 18 in conventional fashion.

Elongated, metal angle members (edge protectors) 56 and 58 are cast in the gauge panel 24 at the upper outer sides thereof, as illustrated in the drawings, and which are held in place by horizontally disposed and horizontally spaced retainers, rods or bars 60 (DBAs) secured thereto. The angle members 56 and 58 are also held in place by a plurality of vertically disposed and horizontally spaced retainers or studs 61 secured thereto having enlarged head portions 61*a* at their lower ends. As will be explained in more detail hereinafter, gauge seals 62 and 64 are secured to the outer sides of each of the gauge panels 24. Inasmuch as gauge seals 62 and 64 are identical, only gauge seal 62 will be described in detail.

Figure 3:
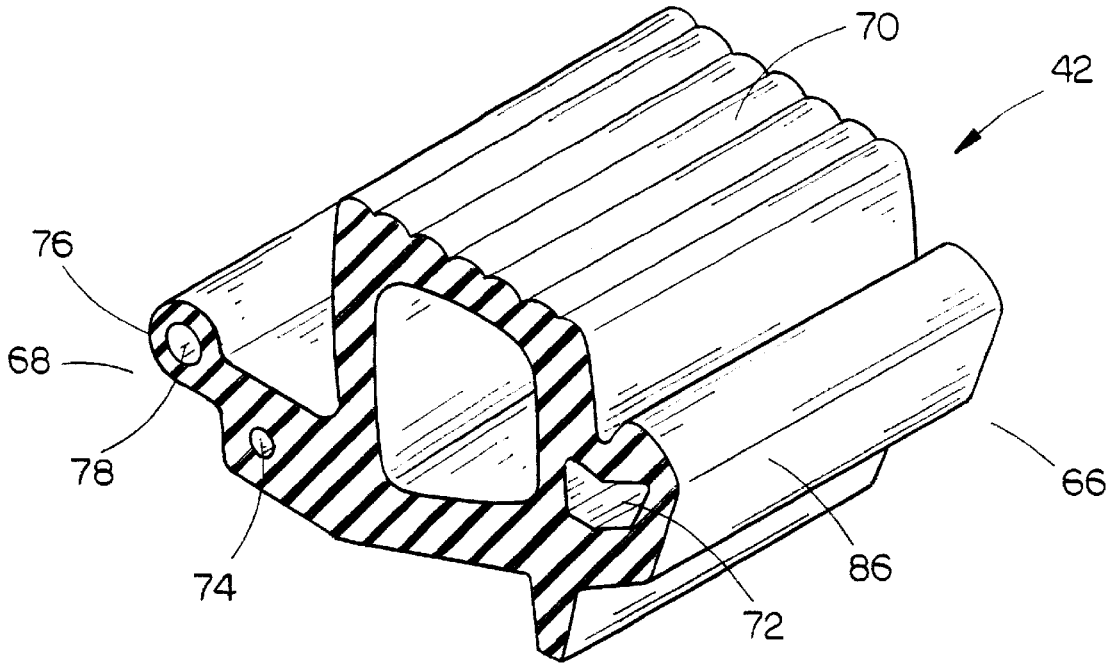
FIG. 3 is a partial perspective view of one of the field panel seals of the invention.
Figure 6:
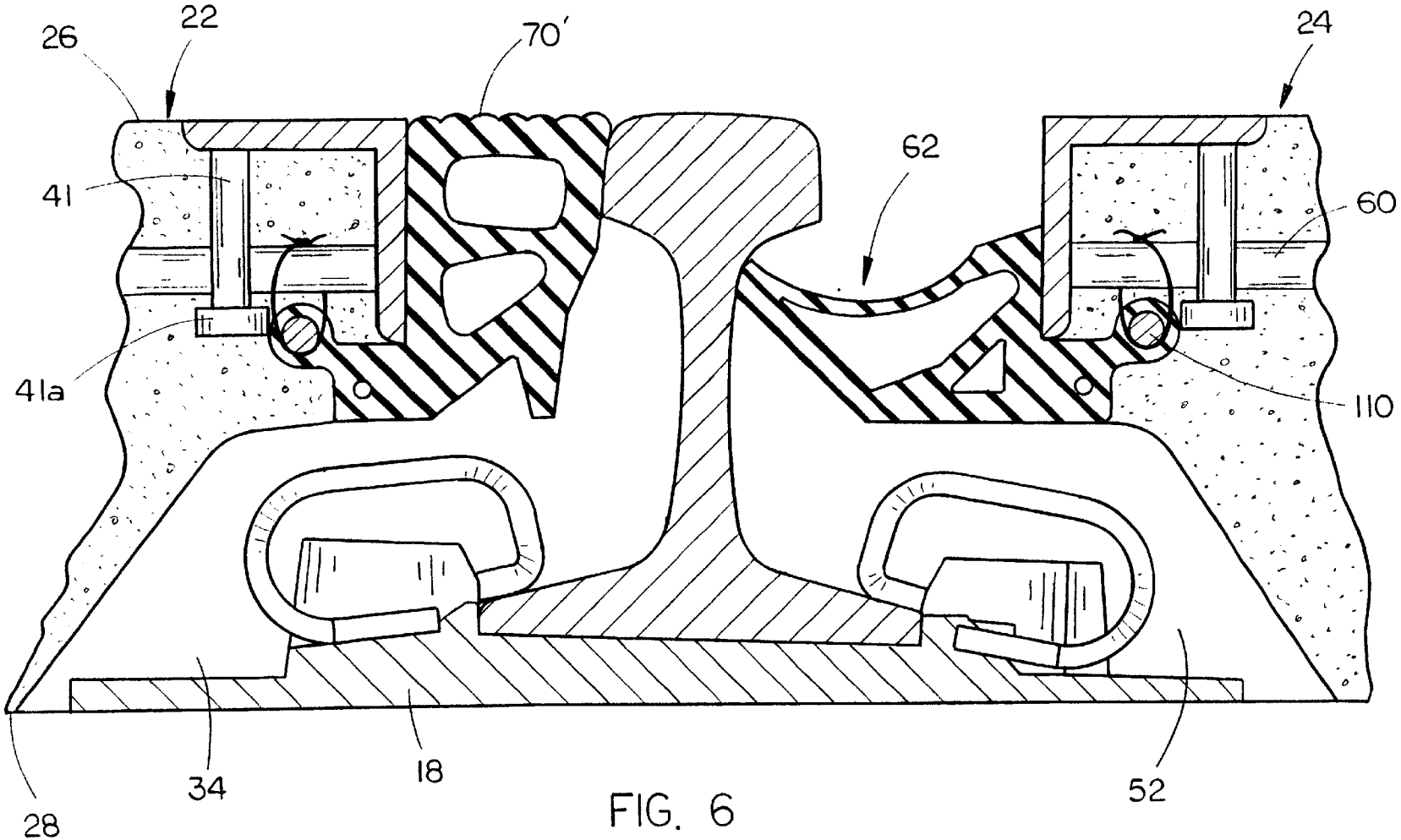
FIG. 6 is a partial perspective view of a modified form of the invention.

As seen in FIG. 3, field seal 42 is comprised of an elastomeric material generally having an outer end 66 and an inner end 68. The upper end 70 of seal 42 is ribbed, as illustrated in FIG. 3, with upper end 70 being preferably positioned below the top surface of the panel 22 and below the upper end of the associated rail. FIG. 6 illustrates an embodiment of the seal wherein the upper end 70' of seal 42' is substantially coplanar with the top surface of the panel. Seal 42' is identical to seal 42 except for the height thereof and will not be described in detail.

Figure 7:
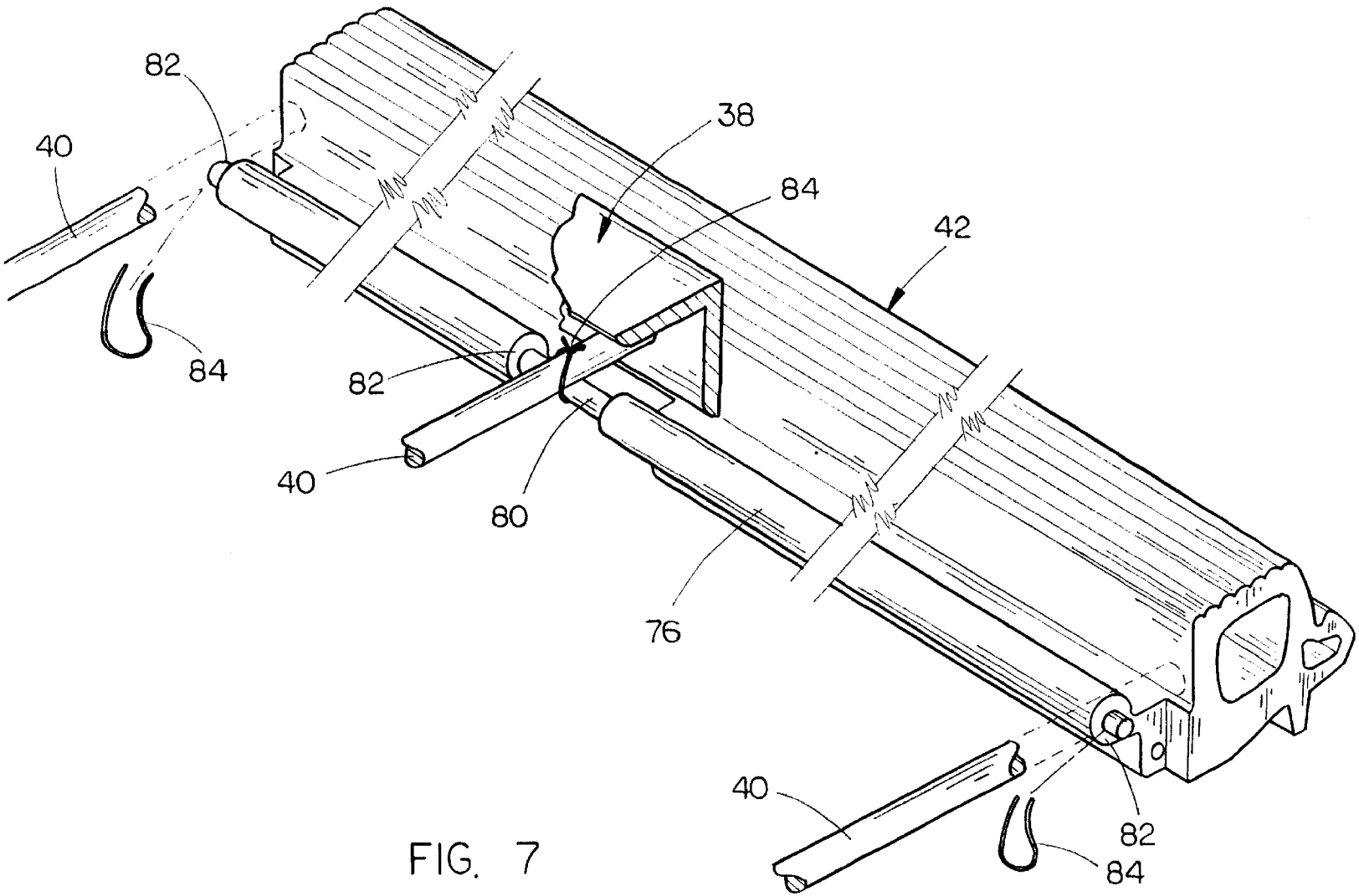
FIG. 7 is a partial perspective view illustrating the manner in which the seals are secured to the rebar.

Elongated voids 72 and 74 are formed in the seal 42 to reduce the amount of material required to fabricate the seal. Additional voids may be utilized if so desired. The inner end 68 of seal 42 has a lobe, nose or protrusion 76 extending therefrom which is embedded in the concrete of the panel 22. Lobe 76 has an elongated bore or opening 78 extending lengthwise therethrough which receives an elongated bar or rod 80 therein. Bar 80 is preferably comprised of a rebar, but could be a flat bar, a round bar or a square bar. Lobe 76 has a plurality of cut-away areas 82 formed therein to expose portions of the bar 80 (FIG. 7). The exposed portions of the bar are secured to the DBAs 40 by tie wires 84 which are extended around the bar 80 and DBA 40 and twisted or tied to facilitate the connection therebetween. The connection of the bar 80 to the DBAs 40 along the length of the bar 80 at spaced locations firmly attaches the seal 42 to the field panel 22 without the need for embedding the vertical leg of the edge protector 38 in the seal 42.

Figure 5:
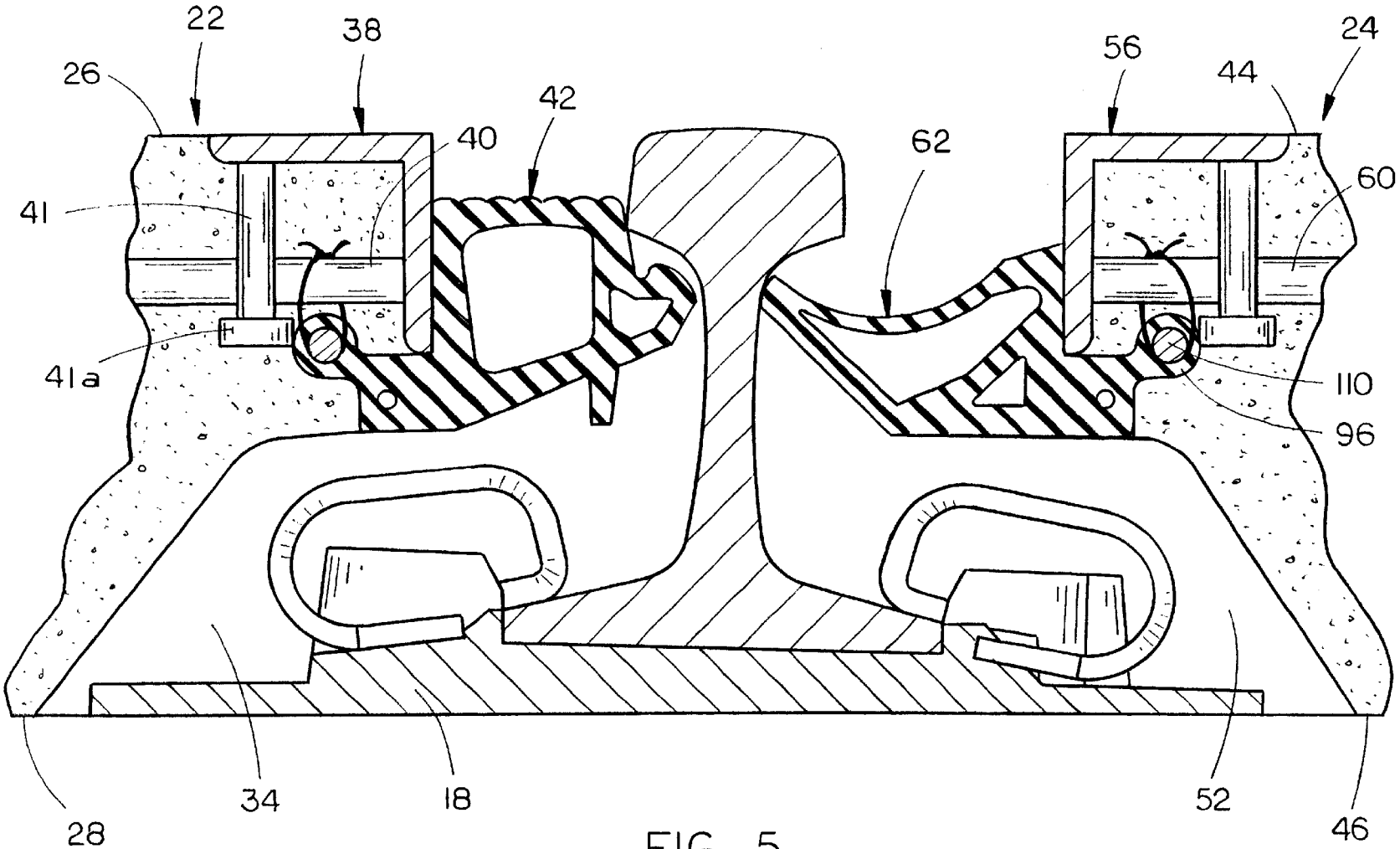
FIG. 5 is a partial vertical sectional view of the concrete railroad grade crossing of this invention.

The outer end of the seal 42 is arcuate in shape, as best seen in FIG. 3, to provide an arcuate surface 86 which is in contact with the arcuate shape of the rail below the head of the associated rail (FIG. 5). The engagement of the outer end of the upper end 70 of the seal 42 with the side of the head of the rail 12 and the engagement of the arcuate portion 86 with the side of the rail creates a seal to prevent foreign material such as concrete, rocks, etc., from falling down into the space below the seal 42.

Figure 4:
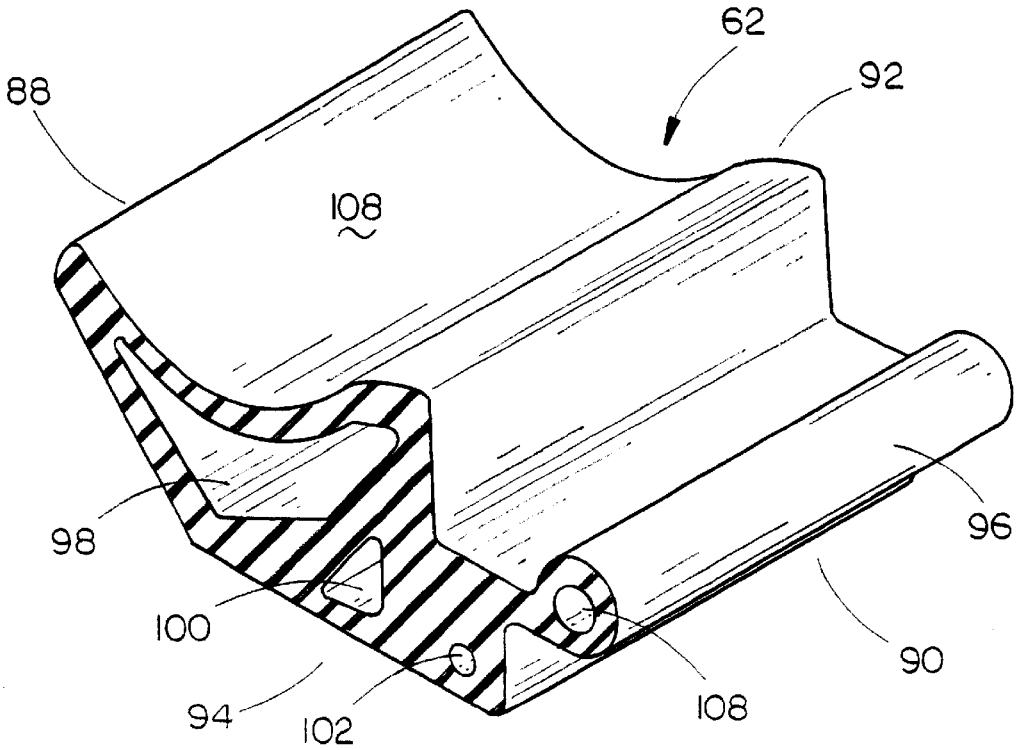
FIG. 4 is a partial perspective view of the gauge panel seal of the invention.

As seen in FIG. 4, each of the gauge seals 62 generally has an outer end 88, inner end 90, upper end 92, and lower end 94. Seal 62 is formed of a suitable elastomeric material and has lobe 96 at its inner end. Seal 62 is provided with voids 98, 100 and 102 formed therein to reduce the amount of material required to fabricate the seal. Additional voids may be formed in the seal 62 if desired. Void 98 also creates additional flexibility in the outer end 88 of the seal 62 so that it may flex somewhat so as to be in engagement with the arcuate portion of the inner end of the side of the associated rail. Seal 62 is provided with an arcuate recessed portion 108 formed therein for sealing the flange of the railroad wheels moving along the rails. Lobe 96 has an elongated bore or opening 108 extending lengthwise therethrough which receives an elongated bar or rod 110 therein. Bar 110 is preferably comprised of a rebar, but could be a flat bar, a round bar or a square bar. Lobe 96 has a plurality of cut-away areas formed therein to expose portions of the bar 110 in the same manner as the cut-away areas are formed in lobe 76. The exposed portions of the bar 110 are secured to the DBAs 60 by tie wires 114 which are extended around the bar 110 and DBA 60 and twisted or tied to facilitate the connection therebetween. The connection of the bar 110 to the DBAs 60 along the length of the bar 110 at spaced locations firmly attaches the seal 62 to the gauge panel 24 without the need for embedding the vertical leg of the edge protector in the seal 62.

Thus it can be seen that the invention accomplishes at least all of its stated objectives.

We claim:

1. A railroad grade crossing for extending a roadway across a pair of parallel, spaced-apart rails which are supported upon spaced-apart ties, comprising:

a concrete gauge panel extending substantially between the rails;

said gauge panel having a top surface which is substantially coplanar with the roadway;

said gauge panel having a bottom surface which is supported upon the ties;

said gauge panel having opposite sides;

said gauge panel having elongated elastomeric gauge seals on each side thereof which are positioned adjacent the rails;

each of said gauge seals generally having upper and lower ends and inner and outer ends;

each of said inner ends of said gauge seals having a lobe which is cast in said gauge panel at the sides thereof;

said gauge panel having metal angle members cast in said upper opposite sides thereof;

said gauge panel having retainer members cast therein which are connected to said metal angle members;

each of said lobes of said gauge seal having an opening formed therein;

an elongated bar positioned in said opening which extends along at least a portion of the length of said lobe of said gauge seal;

each of said lobes of said gauge seal having at least one cut-away portion formed therein for exposing a portion of the length of the rebar therein;

said exposed portion of said bar in said lobe of said gauge seal being secured to at least one of said retainer members in said gauge panel;

a pair of concrete field panels, one of which extends between each rail and the roadway;

each of said concrete field panels having an inner end, an outer end, a top surface which is substantially coplanar with the roadway, and a bottom surface which is supported upon the ties;

said field panels having elongated elastomeric approach seals at their inner ends thereof which are positioned adjacent the associated rail;

each of said field seals generally having an inner end, an outer end, an upper end, and a lower end;

each of said inner ends of said field seals having a lobe which is cast in said inner ends of said approach panels;

the upper inner end of said field panels having a metal angle member cast therein;

said field panels having retainer members cast therein which are connected to said metal angle members;

said lobe of each of said field seal having an opening formed therein;

an elongated bar positioned in said opening which extends along at least a portion of the length of said lobe of said field panel;

said lobe of said field panel having at least one cut-away portion formed therein for exposing a portion of the length of the bar therein;

said exposed portion of said bar in said field seal being secured to at least one of said retainer members in said field panel.

2. The railroad crossing of claim 1 wherein each of said gauge and field seals have elongated voids formed therein.

3. The railroad crossing of claim 1 wherein said top surfaces of said field seals have ribbed surfaces formed therein.

4. A railroad grade crossing for extending a roadway across a pair of parallel, spaced-apart rails which are supported upon spaced-apart ties, comprising:

a concrete gauge panel extending substantially between the rails;

said gauge panel having a top surface which is substantially coplanar with the roadway;

said gauge panel having a bottom surface which is supported upon the ties;

said gauge panel having opposite sides;

said gauge panel having an elastomeric gauge seal on each side thereof which is positioned adjacent a respective rail;

each of said gauge seals having upper and lower ends and inner and outer ends;

each of said gauge seals having a lobe formed in its inner end;

said lobes on said gauge seals being cast in said gauge panel at the sides thereof;

said gauge panel having metal angle members cast in said upper opposite sides thereof;

said gauge panel having retainer members cast therein which are connected to said metal angle members;

each of said lobes of said gauge seal having an opening formed therein;

an elongated bar positioned in said opening which extends along at least a portion of the length of said lobe of said gauge seal;

each of said lobes of said gauge seal having at least one cut-away portion formed therein for exposing a portion of the length of the bar therein;

said exposed portion of said bar being secured to at least one of said retainer members in said gauge panel.

5. The railroad crossing of claim 4 wherein said gauge seals have elongated voids formed therein.

6. A field panel for a railroad grade crossing for extending a roadway across a pair of parallel, spaced-apart rails which are supported upon spaced-apart ties, comprising:

a pair of concrete field panels, one of which extends between each rail and the roadway;

each of said concrete field panels generally having an inner end, an outer end, a top surface which is substantially coplanar with the roadway, and a bottom surface which is supported upon the ties;

said field panels having elastomeric approach seals at their inner ends thereof;

each of said field seals having an inner end, an outer end, an upper end, and a lower end;

each of said inner ends of said field seals having a lobe which is cast in said inner ends of said field panels;

the upper inner end of said field panels having a metal angle member cast therein;

said field panels having retainer members cast therein which are connected to said metal angle members;

said lobe of each of said field seal having an opening formed therein;

an elongated bar positioned in said opening which extends along at least a portion of the length of said lobe of said field panel;

said lobe of said field panel having at least one cut-away portion formed therein for exposing a portion of the length of the bar therein;

said exposed portion of said bar being secured to at least one of said retainer members.

7. A railroad grade crossing for extending a roadway across a pair of parallel, spaced-apart rails which are supported upon spaced-apart ties, comprising:

a concrete gauge panel extending substantially between the rails;

said gauge panel having a top surface which is substantially coplanar with the roadway;

said gauge panel having a bottom surface which is supported upon the ties;

said gauge panel having opposite sides;

said gauge panel having elastomeric gauge seals on each side thereof which are positioned adjacent the rails;

each of said gauge seals generally having upper and lower ends and inner and outer ends;

each of said inner ends of said gauge seals having a lobe which is cast in said gauge panel at the sides thereof;

said gauge panel having metal angle members cast in said upper opposite sides thereof;

said gauge panel having retainer members cast therein which are connected to said metal angle members;

each of said lobes of said gauge seal having an opening formed therein;

an elongated bar positioned in said opening which extends along at least a portion of the length of said lobe of said gauge seal;

each of said lobes of said gauge seal having at least one cut-away portion formed therein for exposing a portion of the length of the bar therein;

said exposed portion of said bar being secured to at least one of said retainer members in said gauge panel;

a pair of concrete field panels, one of which extends between each rail and the roadway;

each of said concrete field panels having an inner end, an outer end, a top surface which is substantially coplanar with the roadway, and a bottom surface which is supported upon the ties;

said field panels having elastomeric field seals at their inner ends thereof which are positioned adjacent the associated rail;

each of said field seals generally having an inner end, an outer end, an upper end, and a lower end;

each of said inner ends of said field seals having a lobe which is cast in said inner ends of said field panels;

the upper inner end of said field panels having a metal angle member cast therein;

said field panels having retainer members cast therein which are connected to said metal angle members;

said lobe of each of said field seal having an opening formed therein;

an elongated bar positioned in said opening which extends along at least a portion of the length of said lobe of said field panel;

said lobe of said field panel having at least one cut-away portion formed therein for exposing a portion of the length of the bar therein;

said exposed portion of said bar being secured to at least one of said retainer members.

* * * * *